US008659542B2

(12) United States Patent
Liu et al.

(10) Patent No.: US 8,659,542 B2
(45) Date of Patent: Feb. 25, 2014

(54) DRIVING CIRCUIT FOR DRIVING AN ELECTRONIC PAPER WITH BLACK AND WHITE DATA VOLTAGES

(75) Inventors: Cheng-Chin Liu, Hsinchu (TW); Shih-Chuan Huang, Hsinchu (TW)

(73) Assignee: Orise Technology Co., Ltd., Hsinchu (TW)

( * ) Notice: Subject to any disclaimer, the term of this patent is extended or adjusted under 35 U.S.C. 154(b) by 254 days.

(21) Appl. No.: 13/204,847

(22) Filed: Aug. 8, 2011

(65) Prior Publication Data

US 2012/0038686 A1 Feb. 16, 2012

(30) Foreign Application Priority Data

Aug. 11, 2010 (TW) ..... 99126818 A

(51) Int. Cl.
*G09G 3/34* (2006.01)

(52) U.S. Cl.
USPC ..... 345/107

(58) Field of Classification Search
USPC ..... 345/107
See application file for complete search history.

(56) References Cited

U.S. PATENT DOCUMENTS

| | | | | |
|---|---|---|---|---|
| 6,778,158 | B2 | 8/2004 | Sun | |
| 2006/0279526 | A1 * | 12/2006 | Zhou et al. | 345/107 |
| 2009/0189884 | A1 * | 7/2009 | Maeda | 345/214 |
| 2009/0195566 | A1 * | 8/2009 | Miyazaki | 345/690 |
| 2009/0267969 | A1 * | 10/2009 | Sakamoto | 345/690 |
| 2011/0141086 | A1 * | 6/2011 | Huang et al. | 345/211 |

* cited by examiner

*Primary Examiner* — Chanh Nguyen
*Assistant Examiner* — Long D Pham
(74) *Attorney, Agent, or Firm* — WPAT, PC; Justin King

(57) ABSTRACT

A driving circuit for driving electronic paper is provided, which includes a plurality of driving units. Each driving unit couples to display units of a row of the electronic paper through a data terminal for driving a display unit from a previous gray level to a target gray level during a driving period. Each driving unit includes a data driver and a switch. The data driver respectively provides a black data DC voltage and a white data DC voltage to the data terminal during a black phase and a white phase of the driving period, and provides a first pulse and a second pulse to the data node during a program phase of the driving period. The switch conducts the data node to a middle voltage between the first pulse and the second pulse.

10 Claims, 5 Drawing Sheets

DRIVING CIRCUIT FOR DRIVING AN ELECTRONIC PAPER WITH BLACK AND WHITE DATA VOLTAGES

This application claims the benefit of Taiwan application Serial No. 99126818, filed Aug. 11, 2010, the subject matter of which is incorporated herein by reference.

FIELD OF THE INVENTION

The present invention relates to a driving circuit for driving electronic paper, and more particularly to a driving circuit capable of effectively reducing current while driving electronic paper.

BACKGROUND OF THE INVENTION

Electronic paper has become an important aspect of modern displays due to its advantaged features such as low power consumption, light weight and decreased thickness. An electronic paper includes a plurality of display units arranged in matrix, and each display unit is filled with colored particles carrying electric polarization. As a driving circuit provides electric potentials building electric field in each display unit by applied cross voltage, positions of particles in each display unit can be controlled to demonstrate various gray levels. Once a gray level is built in each display unit, it maintains for a long time (e.g., several hours) without fading even when power is no longer supplied, therefore the average power consumption of electronic paper can be reduced.

While driving gray level in each display unit by applied cross voltage, the driving circuit need to alternately provides a positive pulse and a negative pulse of different polarities with a positive voltage source and a negative voltage source respectively, and a difference between peak voltages of the positive pulse and the negative pulse is quite large, e.g., several tens of Volts. For a direct and immediate transition from the positive pulse to the negative pulse, the negative voltage source will drain a large amount of transient current for sustaining the difference between peak voltages of the positive and negative pulses. Similarly, for a direct transition from the negative pulse to the positive pulse, the positive voltage source needs to drain a large amount of current to sustain the peak voltage difference of the positive and the negative pulses. As large amount of transient current damages electrodes of electronic paper, yield of electronic papers is decreased. Also, operation voltages of driving circuit also become unstable, and the driving circuit is left vulnerable.

SUMMARY OF THE INVENTION

Therefore, an aspect of the present invention is to provide a driving circuit for driving an electronic paper, the electronic paper comprising a plurality of display units with each display unit driven from a previous gray level to a target gray level by a first pulse and a second pulse during a program phase, each of the plurality of display units comprising a data node and a common node, and the driving circuit comprising: a common terminal coupled to the common nodes of the plurality of display units; a common driver coupled to the common terminal providing a predetermined DC voltage to the common terminal during the program phase; and a plurality of driving unit, each driving unit comprising: a data terminal coupled to one of the data nodes of the plurality of display units; a data driver coupled to the data terminal providing the first pulse and the second pulse to the data terminal, wherein a peak voltage of the first pulse is different from that of the second pulse; and a switch coupled to the data terminal, wherein when the data driver provides the first pulse and the second pulse, the switch does not conduct, and the switch conducts the data terminal to a middle voltage between the first pulse and the second pulse, wherein the middle voltage is between the peak voltages of the first pulse and the second pulse.

Numerous objects, features and advantages of the present invention will be readily apparent upon a reading of the following detailed description of embodiments of the present invention when taken in conjunction with the accompanying drawings. However, the drawings employed herein are for the purpose of descriptions and should not be regarded as limiting.

BRIEF DESCRIPTION OF THE DRAWINGS

The above objects and advantages of the present invention will become more readily apparent to those ordinarily skilled in the art after reviewing the following detailed description and accompanying drawings, in which.

DETAILED DESCRIPTION OF PREFERRED EMBODIMENTS

Figure 1:
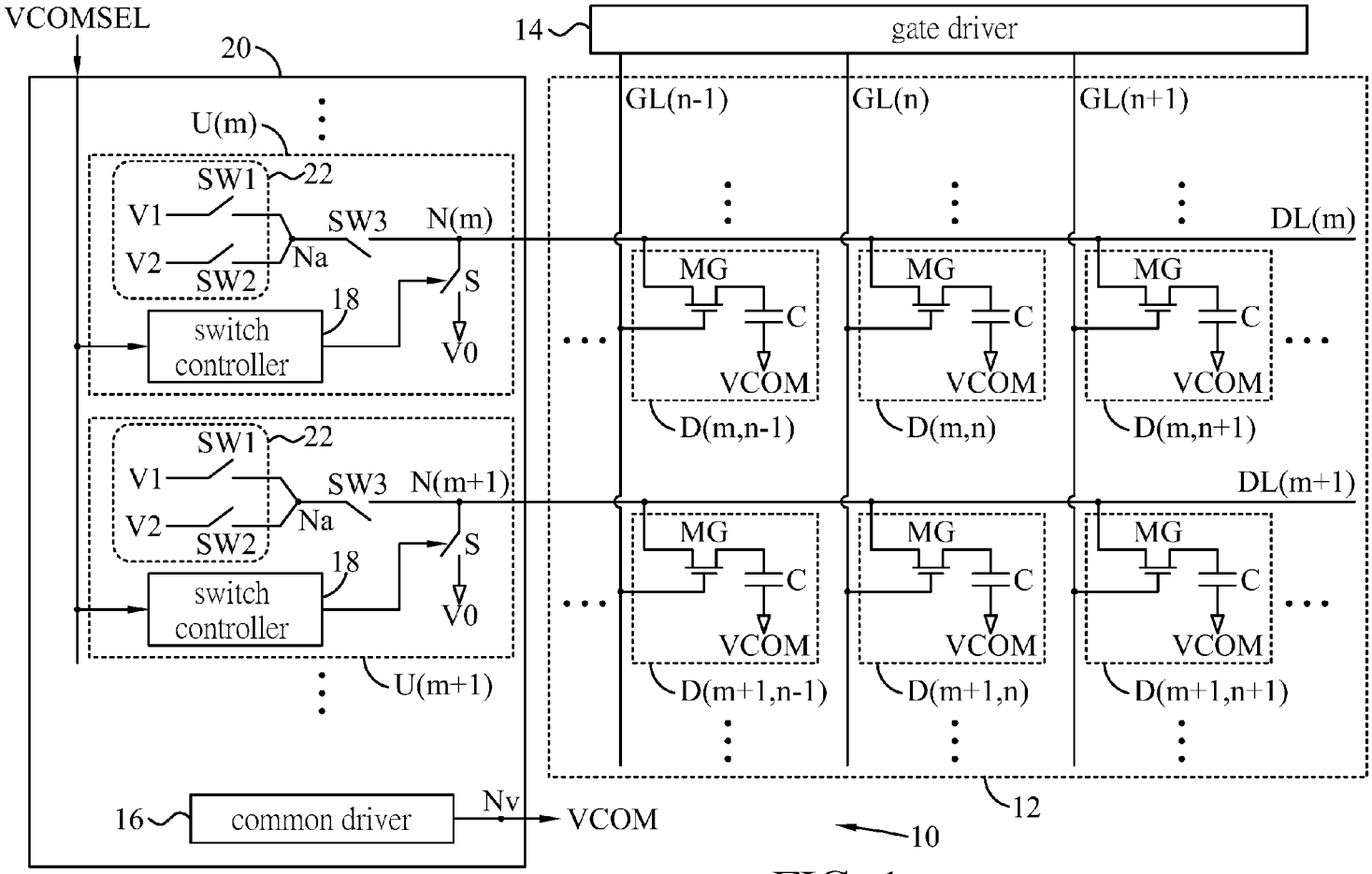
FIG. 1 illustrates a driving circuit according to an embodiment of the invention.

Please refer to FIG. 1 illustrating a driving circuit 20 applied to a display 10 according to an embodiment of the invention. The display 10 can be an electronic book, including an electronic paper 12, a gate driver 14 and a driving circuit 20. The electronic paper 12 has a plurality of display units arranged in matrix, e.g., particle display units represented by the display units D(m,n−1) to D(m+1,n+1) shown in FIG. 1. The display units D(m,n−1), D(m,n) and D(m,n+1) are aligned along the m-th row, and the display units D(m+1,n−1), D(m+1,n) and D(m+1,n+1) are aligned along the (m+1)-th row. The display units D(m,n−1) and D(m+1,n−1) are aligned along the (n−1)-th column, and the display units D(m,n) and D(m+1,n) are aligned along the n-th column, etc. Each display unit has the same structure. As an example, the display unit D(m,n) includes a transistor MG, and particles of the display unit is filled in an equivalent capacitor C. The transistor MG can be a thin film transistor. For each of the display units D(m,n−1) to D(m,n+1) of the m-th row, source (as a data node of display unit) and drain of the transistor MG are respectively coupled to a corresponding data line DL(m) and a terminal of the capacitor C, with the other terminal of the capacitor C coupled to a common voltage VCOM. For each of the display units D(m,n) and D(m+1,n) of the n-th column, gate of the transistor MG is coupled to a corresponding selection line GL(n).

Corresponding to the rows of the display units, the driving circuit 20 includes a plurality of driving units, e.g., the driving units D(m) and D(m+1) respectively corresponding to the display units of the m-th row and the (m+1)-th row. Each of the driving units has the same circuitry structure. As an example, the driving unit U(m) includes a data driver 22, a switch SW3, a switch S and a switch controller 18. A node N(m), as a data terminal, is coupled to the display units D(m,n−1) to D(m,n+1) of the m-th row through the corresponding data line DL(m). The switch controller 18 controls whether the switch S conducts the node N(m) to a DC middle voltage V0. As shown in the embodiment of FIG. 1, the switch controller 18 controls the switch S according to a signal (a common selection signal) VCOMSEL. The switch SW3 is coupled between nodes Na and N(m), and the data driver 22 includes two switches SW1 and SW2. When the switch SW3 conducts the node Na to the node N(m), the switches SW1 and SW2 respectively control whether the node N(m) is conducted to voltage sources V1 and V2 through the node Na. The middle voltage V0 can be a ground voltage, e.g., a system ground voltage of the whole display 10. The voltage source V1 can be a positive voltage source supplying voltage greater (higher) than the middle voltage V0, and the voltage source V2 can be a negative voltage source providing voltage less (lower) than the middle voltage V0. In addition, the driving circuit 20 includes a common driver 16 with a node Nv, as a common terminal, coupled to each of the display units D(m,n−1) to D(m+1,n+1) through a common electrode (not shown) of the electronic paper 12 for providing the common voltage VCOM for each of the display units.

Through the selection lines GL(n−1) to GL(n+1), the gate driver 14 respectively controls whether the display units of the (n−1)-th to (n+1)-th columns are conducted to corresponding data lines. For example, the gate driver 14 can conduct the transistors MG of the display units D(m,n) and D(m+1,n) through the selection GL(n), and then turns off the transistors MG of the display units D(m,n−1), D(m+1,n−1), D(m,n+1) and D(m+1,n+1) through the selection lines GL(n−1) and GL(n+1). Consequently, for the m-th row, only the display unit D(m,n) has its capacitor C conducted to the data line DL(m), so the driving unit U(m) of the circuit 20 can drive the display unit D(m,n) from a previous gray level to a target gray level through the node N(m). Similarly, the driving unit U(m+1) can drive gray level change of the display unit D(m+1,n) through the node N(m+1) and the data line DL(m+1).

Figure 2:
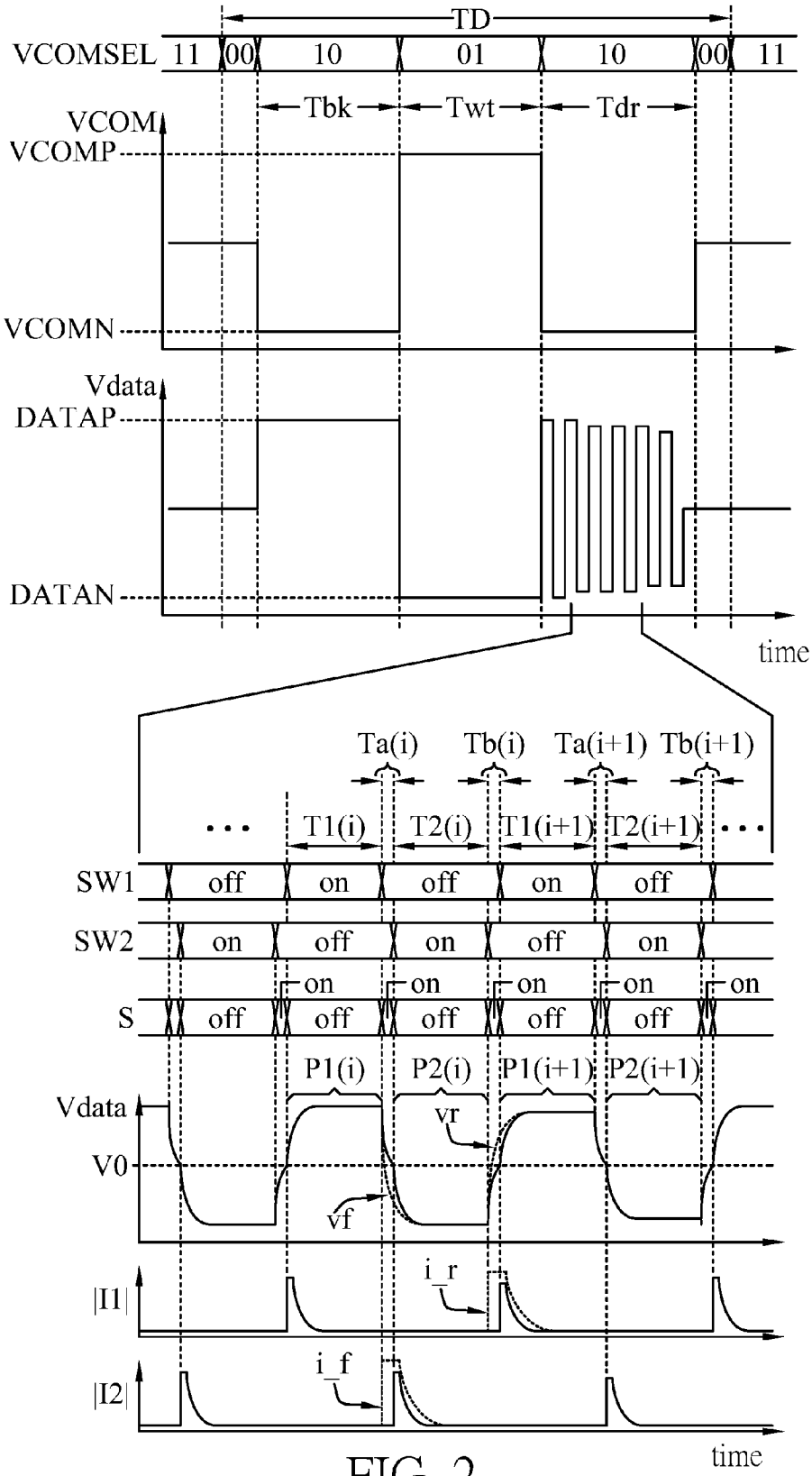
FIG. 2 illustrates operation of the driving circuit shown in FIG. 1 with waveform timing diagrams according to an embodiment of the invention.

Please refer to FIG. 2. As the driving unit U(m) of the driving circuit 20 drives the display unit D(m,n) from the previous gray level to the target gray level through the node N(m), a voltage Vdata represents voltage of the node N(m). The driving circuit 20 controls operation timing of the driving unit U(m) according to the signal VCOMSEL, which can be a binary digital signal. As shown in FIG. 2, when the signal VCOMSEL is binary "11", the voltage Vdata and the common voltage VCOM can be floating. For example, the switches SW3 and S of the driving unit U(m) do not conduct, so the node N(m) is left floating, and the display unit D(m,n) remains the previous gray level.

When the signal VCOMSEL transits from the binary code "11" to a binary code "00", the driving unit U(m) starts a driving period TD, so the display unit D(m,n) can be driven to the target gray level from the previous gray level during the driving period TD. While the signal VCOMSEL remains the code "00", the voltage Vdata and the common voltage VCOM are kept floating.

When the signal VCOMSEL transits from the binary code "00" to a code "10", the driving unit U(m) and the common driver 16 start a black phase, i.e., the interval Tbk shown in FIG. 2. In the black phase Tbk, the display unit D(m,n) is driven to a black level from the previous gray level. Among various gray levels (or color levels) the display unit D(m,n) is capable of demonstrating, there are two extremes: a minimum and a maximum; the black level is one of the extremes, and the other extreme is relatively a white level. For driving the display unit D(m,n) to the black level during the black phase Tbk, the common driver 16 provides a DC voltage VCOMN, a black common DC voltage, as the common voltage VCOM, and the driving unit U(m) provides a DC voltage DATAP, a black data DC voltage, as the voltage Vdata.

When the signal VCOMSEL transits from the binary code "10" to a code "01", the driving unit U(m) and the common driver 16 enter a white phase, i.e., an interval Twt, from the black phase for driving the display unit D(m,n) to the white level from the previous black level. To accomplish this, the common driver 16 provides a DC voltage VCOMP, a white common DC voltage, as the common voltage VCOM, and the driving unit U(m) provides a DC voltage DATAN, a white data DC level, as the voltage Vdata of the node N(m). During the black phase and the white phase, voltage levels of the DC voltages DATAP and DATAN are different, and voltage levels of the DC voltages VCOMN and VCOMP are different.

After the black phase Tbk and the white phase Twt, the display unit D(m,n) is reset to the white level from the previous gray level. Then, when the signal VCOMSEL transits from the binary code "01" to the code "10", a program phase starts for driving the display unit D(m,n) to the target gray level from the white level, with the program phase represented by an interval Tdr as shown in FIG. 2. During the program phase Tdr, the common driver 16 keeps the common voltage VCOM at the voltage VCOMN. And the driving unit U(m) alternately provides different pulses with the voltage sources V1 and V2.

Operation of the driving unit U(m) during the program phase Tdr can be illustrated by waveform timing diagrams as shown in lower portion of FIG. 2. In the program phase Tdr, the switch SW3 of the driving unit U(m) keeps conduction, so the voltage Vdata of the node N(m) is controller by the switches SW1 and SW2 of the data driver 22. While the driving unit U(m) operates, the program phase Tdr is further divided into at least a first phase, such as phases T1(*i*) and T1(*i*+1), and at least a second phase, such as phases T2(*i*) and T2(*i*+1), with the first and the second phases arranged alternately. For example, a second phase T2(*i*) between two consecutive first phases T1(*i*) and T1(*i*+1), and a first phase T1(*i*+1) between two consecutive second phases T2(*i*) and T2(*i*+1). In addition, a time slot is arranged between a first phase and a second phase, such as a time slot of a phase Ta(i) between the first phase T1(*i*) and the second phase T2(*i*), a time slot of a phase Tb(i) between the second phase T2(*i*) and another first phase T1(*i*+1), a time slot of a phase Ta(i+1) between the phases T1(*i*+1) and T2(*i*+1), and a time slot of a phase Tb(i+1) following the phase T2(*i*+1).

Under aforementioned timing arrangement, the switch SW1 conducts during each of first phases T1(*i*)/T1(*i*+1), as labeled "on" in FIG. 2, so the voltage source V1 can be conducted to the node N(m) and builds a first pulse higher than the middle voltage V0 for the voltage Vdata of the node N(m), such as pulses P1(*i*) and P1(*i*+1). For the rest of the time excluding the first phases T1(*i*)/T1(*i*+1), the switch SW1 maintains off and does not conduct, as labeled "off" in FIG. 2. On the other hand, the switch SW2 conducts during each of the second phases T2(*i*)/T2(*i*+1), and is off for the rest of the time. As the switch SW2 conducts, the voltage source V2 supplies the node N(m) with voltage lower than the middle voltage V0 to form second pulses of the voltage Vdata, such as pulses P2(*i*) and P2(*i*+1) shown in FIG. 2. The first pulses are higher than the middle voltage V0, and are regarded as positive pulses. Also, the second pulses lower than the middle voltage V0 and are regarded as negative pulses.

According to the physical characteristic of each display unit of electronic paper, each display unit of the electronic paper 12 has to be driven by alternate first and second pulses to approach the target gray level. However, if the first and second pulses alternate directly, the voltage sources V1 and V2 will conduct large amount of transient currents to sustain peak voltage differences between the first and second pulses, and exceeding transient currents will bring many negative impacts. To address the issue, the driving unit U(m) of the invention conducts the node N(m) to the middle voltage V0 during time slots between the first and second phases with the switch S, so the current the voltage sources V1 and V2 conduct can be reduced while the first and second pulses alternate.

To implement the invention, the switch S conducts during the time slots, and keeps off for the rest of the time. For example, as shown by a solid-line waveform of FIG. 2, when the voltage Vdata alternates from the first pulse P1(*i*) of the first phase T1(*i*) to the second pulse P2(*i*) of the second phase T2(*i*), the switch S conducts the node N(m) to the middle voltage V0 during the phase Ta(i), so the voltage Vdata is discharged to the middle voltage V0 from the peak voltage of the pulse P1(*i*). After the phase Ta(i) ends, the switch SW2 conducts in turn, then the voltage Vdata is further pulled down to the peak voltage of the pulse P2(*i*). During the phase Ta(i), the middle voltage V0 drains current to drive the voltage Vdata down to the middle voltage V0 from the peak voltage of the pulse P1(*i*). Since the middle voltage V0 is the system ground of the display 10 and is commonly maintained by the whole system of the display 10, current drained by the middle voltage V0 will not cause loading effort of the driving circuit 20. As the voltage source V2 is conducted to the node N(m) after the phase T2(*i*) starts, it only needs to transit the voltage Vdata from the middle voltage V0 to the peak voltage of the pulse P2(*i*). The current I2 (solid-line waveform) of FIG. 2 shows current conducted by the voltage source V2 (in absolute value).

In contrast to the invention, if the switch S does not conduct the node N(m) to the middle voltage V0 between the phases T1(*i*) and T2(*i*) (i.e., phase Ta(i) equals zero), the first pulse P1(*i*) will directly transit to the second pulse P2(*i*) following the dash-line waveform of after the switch SW2 conducts, so the full peak voltage difference between the pulses P1(*i*) and P2(*i*) has to be driven by the source voltage V2 alone, and the current I2 which the voltage source V2 must conduct is shown as the dash-line waveform i_f. Comparing the solid-line waveform (the invention) and the dash-line waveform (without the invention) of the current I2, it is understood that the transient current of the voltage source V2 needs to conduct is lower and duration of the transient current by adopting the invention is shorter, and then negative impacts due to exceeding transient current can therefore be avoided. Comparing to temporal integral of the transient current without the invention applied, the temporal integral of the transient current with the invention applied is reduced to half, so the invention can effectively reduce impact of exceeding transient current.

According to the same principle, when the voltage Vdata transits from the second pulse P2(*i*) of the phase T2(*i*) to the first pulse P1(*i*+1) of the phase T1(*i*+1), the switch S conducts during the phase Tb(i), and the middle voltage V0 supplies current to charge the node N(m) to the middle voltage V0. When the phase T1(*i*+1) starts, the voltage V1 is conducted to the node N(m) in turn, so the voltage Vdata is pulled up to peak voltage of the first pulse P1(*i*+1) by current provided by the voltage source V1. That is, while the pulse P2(*i*) transits to the pulse P1(*i*+1), the voltage source V1 does not need to drive the full peak voltage difference between the pulses P2(*i*) and P1(*i*+1). It only drives the voltage Vdata from the middle voltage V0 to the peak voltage of the pulse P1(*i*+1). In FIG. 2, the solid-line waveform of the current I1 represents current conducted by the voltage source V1 (in absolute value).

In contrast, without the invention, the voltage Vdata direct transits from the peak voltage of the pulse P2(*i*) to that of the pulse P1(*i*+1) following the dash-line waveform vr after the switch S1 conducts, and the voltage source V1 needs to drive the full peak voltage difference between the pulses P2(*i*) and P1(*i*+1). The transient current conducted by the voltage source V1 is shown by the dash-line waveform i_r. It is therefore understood that the transient current of the voltage source V1 needs to conduct is decreased and lasts shorter in time by applying the invention.

After the program phase Tdr ends, the display unit D(m,n) can be driven to the target gray level by the driving unit U(m). The signal VCOMSEL transits from the binary code "10" to the code "00", then ends the driving period TD after transits to the code "11". The driving unit U(m) will leave the node N(m) floating. For example, the switches SW3 and S are controlled not to conduct, and power is not supplied to the display unit D(m,n), while the physical characteristics of the display unit D(m,n) can sustain its gray level. The binary codes "00", "01", "10" and "11" of the signal VCOMSEL can be viewed as first to fourth codes.

For different target gray levels, the peak voltages of the first and/or second pulses and durations of them (i.e., lasting time of the first and/or second phases) are different. That is, the driving unit U(m) drives the display unit D(m,n) to various gray levels by adjusting the peak voltages of the first and/or the second pulses, their lasting times (durations of the first and/or second phases) and/or number of pulses. In another embodiment of the invention, whether the switch S conducts is further determined according to the peak voltage difference between the first and the second pulses. When the peak voltage difference is small, i.e., less than a threshold voltage, the switch S does not need to conduct. Relatively, when the peak voltage difference is large, i.e., greater than the threshold voltage, the switch S conducts to reduce transient currents of the voltage sources V1 and V2.

Figure 3:
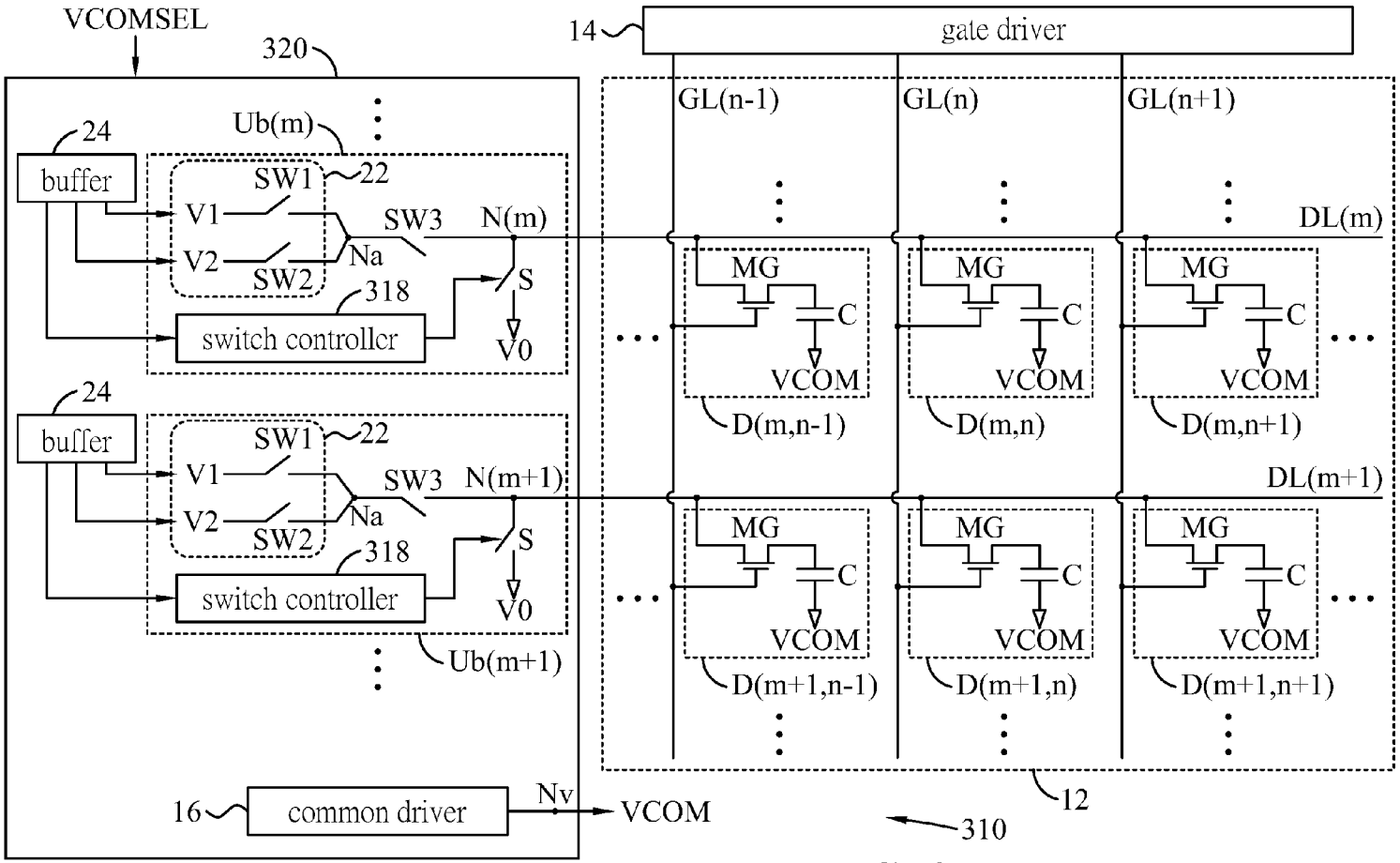
FIG. 3 illustrates a driving circuit according to another embodiment of the invention.

In FIG. 3 according to another embodiment of the invention, a driving circuit 320 operates with the gate driver 14 for driving each of the display units D(m,n−1) to D(m+1,n+1) of the electronic paper 12 according to timing control of the signal VCOMSEL. Corresponding to the rows of the display units, the driving circuit 320 includes driving units such as the driving units Ub(m) and Ub(m+1) respectively corresponding to the display units D(m,n−1) to D(m,n+1) of the m-th row and the display units D(m+1,n−1) to D(m+1,n+1) of the (m+1)-th row. Taking the driving unit Ub(m) as an example, a node N(m) works as its data terminal coupled to the display units of the m-th row through a data line DL(m), and the driving unit Ub(m) includes a data driver 22, a switch SW3 and a switch controller 318. The data driver 22 is coupled to the node N(m) through the switch SW3. The switch S is coupled between the node N(m) and a middle voltage V0. The switch controller 318 is coupled to the switch S controlling whether the switch S conducts. In addition, the driving circuit 320 also includes a common driver 16 with a node Nv as a common terminal coupled to the display units U(m,n−1) to U(m+1,n+1) for providing a common voltage VCOM.

Figure 4:
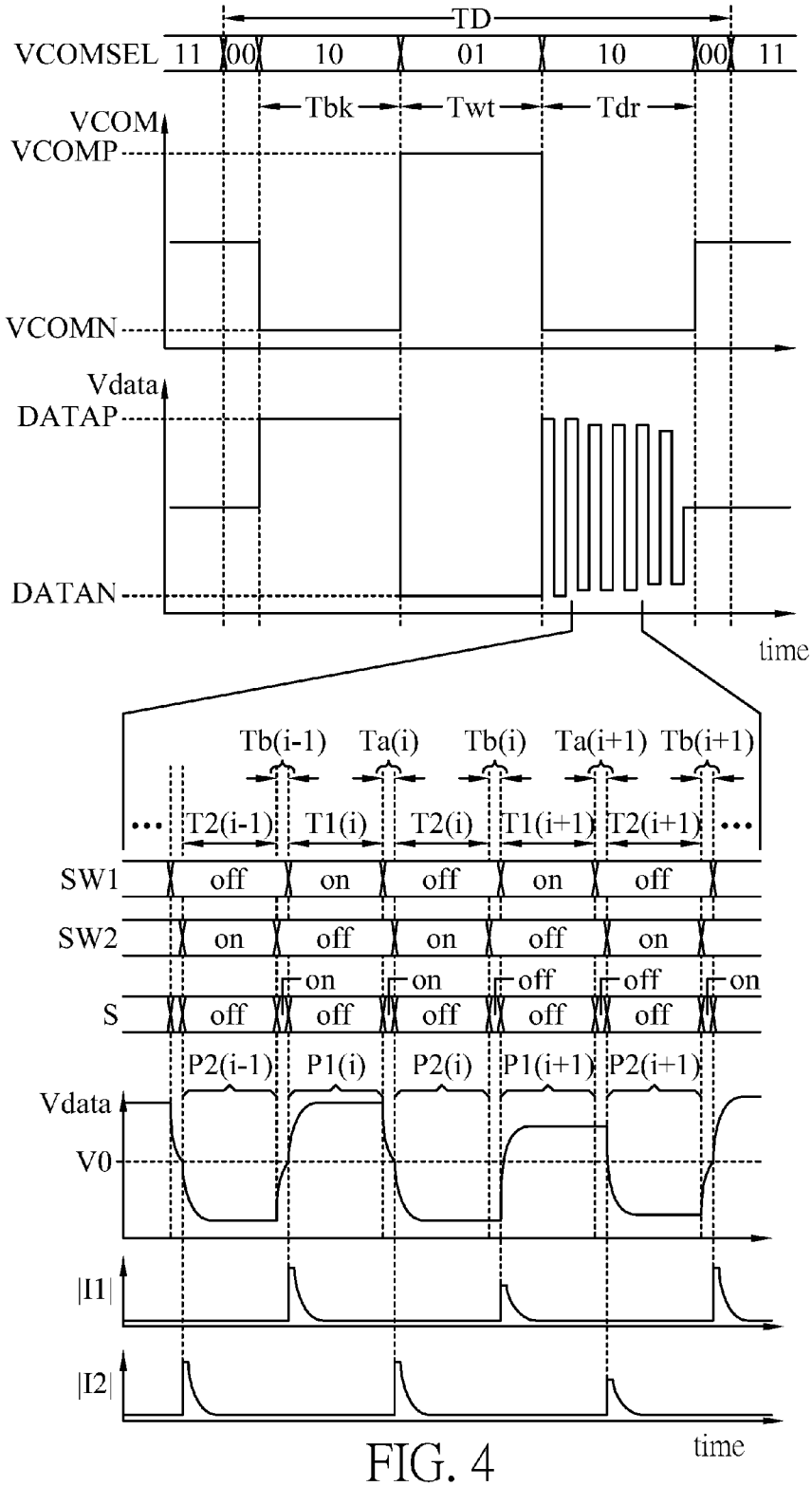
FIG. 4 illustrates operation of the driving circuit shown in FIG. 3 with waveform timing diagrams according to an embodiment of the invention.

Like the embodiment of FIG. 1, as the gate driver 14 controls the selection line GL(n), the driving unit Ub(m) drives the display unit D(m,n) to a target gray level from a previous gray level during a driving period TD. Under timing control of the signal VCOMSEL, the driving period TD also divides to a black phase Tbk, a white phase Twt and a program phase Tdr. The data driver 22 of the driving unit Ub(m) respectively provides at least a first pulse and at least a second pulse to the node N(m) during at least a first phase and at least a second phase of the program phase Tdr, such as pulses P1(*i*)/P1(*i*+1) of phases T1(*i*)/T1(*i*+1) and pulses P2(*i*−1)/P2(*i*)/P2(*i*+1) of phases T2(*i*−1)/T2(*i*)/T2(*i*+1), as shown in FIG. 4. Peak voltage of each first pulse is higher than the middle voltage V0, and peak voltage of each second pulse is lower than the middle voltage V0. Consecutive first phase and second phase is separated by a time slot, such as a phase Tb(i−1) between the phases T2(*i*−1) and T1(*i*), and a phase Ta(i) between the phases T1(*i*) and T2(*i*). The data driver 22 includes switches SW1 and SW2, the switch SW1 conducts a voltage source V1 to the node N(m) during each of the first phases for providing each of the first pulses. The switch SW1 stops conducting during the second phases and the time slots. The switch SW2 conducts a voltage source V2 to the node N(m) during each of the second phases for providing each of the second pulses, and stops conducting between the voltage source V2 and the node N(m) during each of the first phase and the time slot.

When the driving unit Ub(m) drives the display unit D(m, n) to the target gray level, the peak voltages of the pulses can be adjusted according to the target gray level. Corresponding to the driving units Ub(m) and Ub(m+1), each buffer 24 of the driving circuit 320 buffers the peak voltage value of each pulse for a corresponding driving unit. For example, when the driving unit Ub(m) provides the pulse P1(*i*) to voltage Vdata of the node N(m) with the voltage source V1, the corresponding buffer 24 stores a desired value of the peak voltage of the pulse P1(*i*) in advance, so the voltage source V1 can accordingly control the peak voltage of the pulse P1(*i*). Meanwhile, the buffer 24 loads the peak voltage value of the next pulse P2(*i*). When the phase T1(*i*) ends, the voltage source V2 can then control the peak voltage of the pulse P2(*i*) during the phase T2(*i*) according to the peak voltage value previously loaded in the buffer 24, and the buffer 24 loads the peak voltage value of the next pulse P1(*i*+1) in advance.

Because the buffer 24 stores peak voltage values of consecutive pulses, the switch controller 318 of the driving unit Ub(m) determines whether the switch S conducts according to peak voltage difference of the consecutive pulses. The switch controller 318 compares the peak voltages of the consecutive first and second pulses in the program phase Tdr to determine whether the peak voltage difference of the consecutive pulses is greater than a threshold voltage. If the peak voltage difference is greater than the threshold voltage, the switch controller 318 conducts the node N(m) to the middle voltage V0 between the two pulses. Otherwise, if the peak voltage difference is less than the threshold voltage, the switch controller 318 keeps the switch S not conducting during the time slot between the two pulses.

For example, in the phase T2(*i*−1) shown in FIG. 4, because the buffer 24 corresponding to the driving unit Ub(m) has already loaded the peak voltage of the next pulse P1(*i*), the switch controller 318 of the driving unit Ub(m) can compare the peak voltage difference between the pulses P2(*i*−1) and P1(*i*). Assuming the peak voltage difference is greater than the threshold voltage, then the switch controller 318 will conduct the switch S during the phase Tb(i−1) when the voltage Vdata is transiting from the pulse P1(*i*) of the phase T1(*i*) to the pulse P2(*i*) of the phase T2(*i*), so the switch S conducts the middle voltage V0 to the node N(m) to reduce transient current conducted by the voltage source V1.

Similarly, during the phase T1(*i*), as the peak voltage of the next pulse P2(*i*) has already been loaded into the buffer 24, the switch controller 318 can compare the pulses P1(*i*) and the next pulse P2(*i*). Assuming that the peak voltage difference of these two pulses is still greater than the threshold voltage, then the switch controller 318 will conduct the switch S during the phase Ta(i) following the phase T1(*i*), so the middle voltage V0 helps to reduce transient current of the voltage source V2 when the pulse P1(*i*) alternates to the pulse P2(*i*).

In the phase T2(*i*), the switch controller 318 again compares the peak voltage difference of the pulse P2(*i*) and the next pulse P1(*i*+1). Assuming the peak voltage difference of the two pulses is less than the threshold voltage, then the switch controller 318 will not conduct the switch S for the next phase Tb(i). Because the peak voltage difference of the pulses P2(*i*) and P1(*i*+1) is small, the transient current will not be overwhelming even the full peak voltage difference is completely driven by the voltage source V1 alone.

Similarly, during the phase T1(*i*+1), the switch controller 318 compares the peak voltage difference of the pulses P1(*i*+1) and P2(*i*+1). Assuming the peak voltage difference is again less than the threshold voltage, then the switch controller 318 maintains not conducting for the next phase Ta(i+1). Because the peak voltage difference of the pulses P1(*i*+1) and P2(*i*+1) is small, the transient current will not be overwhelming even the full peak voltage difference is completely driven by the voltage source V2 alone. In other words, for the embodiment of FIG. 3 and FIG. 4, the invention determines whether the node N(m) is conducted to the middle voltage V0 during pulse transition dynamically according to peak voltage difference of consecutive two pulses.

Figure 5:
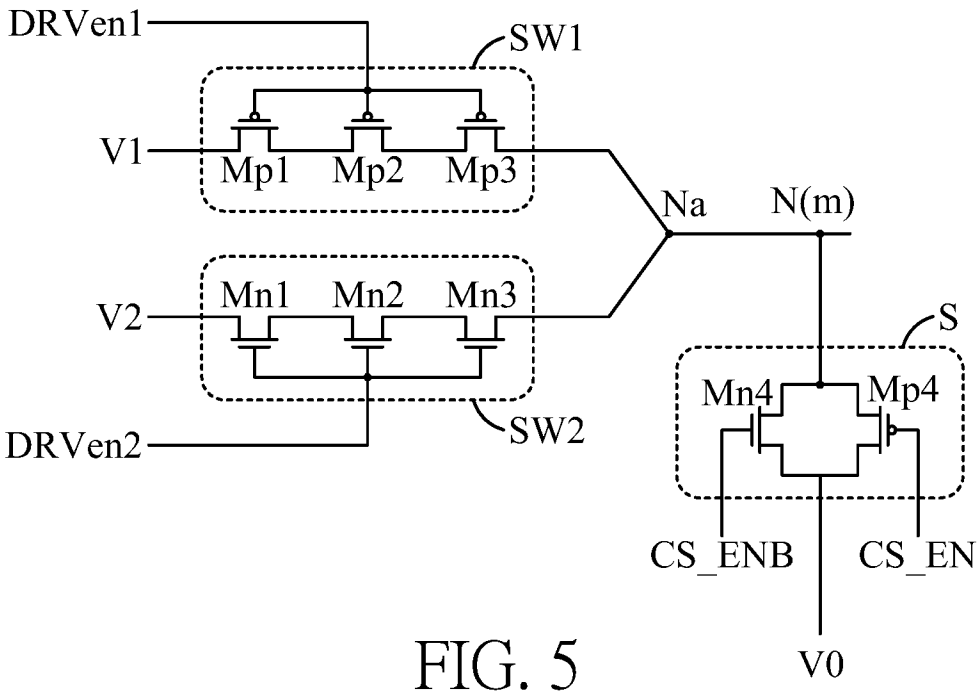
FIG. 5 illustrates the switches of the driving circuits according to an embodiment of the invention.

A circuit embodiment shown in FIG. 5 can be adopted to implement the switches SW1, SW2 and S of FIG. 1 and FIG. 3. The switch SW1 can be implemented by three transistors Mp1, Mp2 and Mp3. These three transistors can be matched p-channel MOS (Metal-Oxide-Semiconductor) transistors with drain-source channels serially coupled between the node Na and the voltage source V1, and gates controlled by a signal DRVen1 (as a first drive enable signal). When the signal DRVen1 is logic 0, the switch SW1 conducts. The switch SW2 can be implemented by three transistors Mn1, Mn2 and Mn3, which can be matched n-channel MOS transistors with source-drain channels serially coupled between the node Na and the voltage source V2, and gates controlled by a signal DRVen2 (as a second drive enable signal). When the signal DRVen2 is logic 1, the switch SW2 conducts. The switch S can be implemented by a transistor Mp4 and a transistor Mn4, the two transistors can respectively be a p-channel MOS transistor and an n-channel MOS transistor with source-drain channels coupled between the middle voltage V0 and the node N(m), and gates respectively controlled by signals CS_EN and CS_ENB (as two switch enable signals). When the signals CS_EN and CS_ENB are respectively logic 0 and logic 1, the switch S conducts, wherein the signals CS_EN and CS_ENB can be mutually inverted.

To sum up, the invention is designed for special driving requirements of electronic paper; while driving gray level transition of electronic paper with alternate pulses of different polarities, the invention can effectively reduce transient currents conducted by the driving circuit and therefore prevent exceeding transient current.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A driving circuit for driving an electronic paper, the electronic paper comprising a plurality of display units driven from a previous gray level to a target gray level by a first pulse and a second) pulse during a program phase, wherein the plurality of display units respectively comprising a data node and a common node, and the driving circuit comprising:

a common terminal, coupled to the common nodes of the plurality of display units;

a common driver, coupled to the common terminal, for providing a predetermined DC voltage to the common terminal during the program phase; and a plurality of driving unit, each of the driving units comprising:

a data terminal, coupled to one of the data nodes of the plurality of display units;

a data driver, coupled to the data terminal, for providing the first pulse and the second pulse to the data terminal, wherein a peak voltage of the first pulse is different from a peak voltage of the second pulse; and a switch, coupled to the data terminal, wherein the switch does not conduct during the first pulse and the second pulse, and the switch conducts the data terminal to a middle voltage between the first pulse and the second pulse, wherein the middle voltage is between the peak voltages of the first pulse and the second pulse, and a switch controller, coupled to the switch, for comparing whether a difference between the peak voltages of the first pulse and the second pulse is greater than a threshold voltage, wherein when the difference is greater than the threshold voltage, the switch controller conducts the switch so the switch conducts the data terminal to the middle voltage between the first pulse and the second pulse, otherwise, the switch controller does not conduct the switch.

2. The driving circuit as claimed in claim 1, wherein the program phase comprises a first phase and a second phase arranged alternately with a time slot between the first phase and the second phase, the data driver provides the first pulse during the first phase and provides the second pulse during the second phase, and the switch conducts the data terminal to the middle voltage during the time slot.

3. The driving circuit as claimed in claim 2, wherein the data driver comprises:

a first switch, for conducting the data terminal to a first voltage source during the first phase in order to provide the first pulse, and stopping conducting the data terminal during the second phase and the time slot; and a second switch, for conducting the data terminal to a second voltage source during the second phase in order to provide the second pulse, and stopping conducting the data terminal during the first phase and the time slot.

4. The driving circuit as claimed in claim 3, wherein the first switch comprises a plurality of first transistors, the first transistors respectively have first drain-source channels serially coupled between the first voltage source and the data terminal, and the first transistors respectively have first gates coupled to a first drive enable signal, and the second switch comprises a plurality of second transistors, the second transistors respectively have second drain-source channels serially coupled between the second voltage source and the data terminal, and the second transistors respectively have second gates coupled to a second drive enable signal.

5. The driving circuit as claimed in claim 1, wherein the switch comprises a first middle transistor and a second middle transistor, the first middle transistor and the second middle transistor respectively have source-drain channels coupled between the middle voltage and the data terminal, the first middle transistor further has a first gate receiving a first switch enable signal, and the second middle transistor further has a second gate receiving a second switch enable signal, wherein the first switch enable signal and the second switch enable signal are mutually inverted.

6. The driving circuit as claimed in claim 1, wherein the driving unit drives one of the plurality of display units coupled to the data terminal from the previous gray level to the target gray level during a driving period according to a common selection signal, wherein the driving period comprises comprising a black phase, a white phase and the program phase; the data driver respectively provides a black data DC voltage and a white data DC voltage to the data terminal during the black phase and the white phase, and the common driver respectively provides a black common DC voltage and a white common DC voltage to the common terminal during the white phase and the black phase, wherein the black data DC voltage and the white data DC voltage are different, and the black common DC voltage and the white common DC voltage are different.

7. The driving circuit as claimed in claim 6, wherein the common selection signal is a digital signal, when the common selection signal transits from a fourth code to a first code, the driving unit starts the driving period, when the common selection signal transits from the first code to a third code, the driving unit starts the black phase, when the common selection signal transits from the third code to a second code, the driving unit transits from the black phase to the white phase, when the common selection signal transits from the second code to the third code, the driving units starts the program phase; and when the common selection signal transits to the fourth code, the driving unit ends the driving period.

8. The driving circuit as claimed in claim 6, wherein the common selection signal is a binary digital signal.

9. The driving circuit as claimed in claim 6, wherein the switch controller further controls the switch to stop conducting during the black phase and the white phase.

10. The driving circuit as claimed in claim 1, wherein the plurality of display units are particle display units.

* * * * *